US008002679B2

(12) United States Patent
Webber et al.

(10) Patent No.: US 8,002,679 B2
(45) Date of Patent: Aug. 23, 2011

(54) CHEST EXERCISE MACHINE WITH SELF-ALIGNING PIVOTING USER SUPPORT

(75) Inventors: Randall T. Webber, La Jolla, CA (US); Christopher E. Brennan, Santee, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 331 days.

(21) Appl. No.: 12/123,984

(22) Filed: May 20, 2008

(65) Prior Publication Data

US 2008/0220950 A1 Sep. 11, 2008

Related U.S. Application Data

(62) Division of application No. 10/633,805, filed on Aug. 4, 2003, now Pat. No. 7,594,880.

(51) Int. Cl.
*A63B 21/00* (2006.01)

(52) U.S. Cl. ..... 482/96; 482/95; 482/72

(58) Field of Classification Search ..... 482/121, 482/10, 11, 44, 95, 96, 72, 137, 130, 142, 482/100; 128/848, 861, 201.11
See application file for complete search history.

(56) References Cited

U.S. PATENT DOCUMENTS

| | | | |
|---|---|---|---|
| 2,145,940 | A | 2/1939 | Marlowe |
| 4,441,708 | A | 4/1984 | Brentham |
| 4,641,833 | A | 2/1987 | Trethewey |
| 4,743,010 | A | 5/1988 | Geraci |
| 4,790,530 | A | 12/1988 | Maag |
| 4,822,038 | A | 4/1989 | Maag |
| 4,844,456 | A | 7/1989 | Habing et al. |
| 4,917,379 | A | 4/1990 | Maag |
| 4,943,051 | A | 7/1990 | Haskins et al. |
| 4,944,641 | A | 7/1990 | Alves |
| 4,949,958 | A | 8/1990 | Richey |
| 5,236,406 | A | 8/1993 | Webber |

(Continued)

FOREIGN PATENT DOCUMENTS

CA 2075331 2/1994

OTHER PUBLICATIONS

U.S. Appl. No. 12/212,090 of Webber et al. filed Sep. 17, 2008.

(Continued)

*Primary Examiner* — Jerome W Donnelly
(74) *Attorney, Agent, or Firm* — Procopio, Cory, Hargreaves & Savitch LLP

(57) ABSTRACT

A chest exercise machine has a main frame, a user support frame pivotally associated with the main frame and movable between a start position and an end position during an exercise, a user engagement device movably mounted relative to the frames and having at least one handle for gripping by a user positioned on the user support, and a connecting linkage which translates movement of the user engagement device to movement of the user support frame. The user engagement device provides articulated motion so that the handle moves in a user-defined chest exercise movement path between a start position and an end position. A load resists movement of at least one of the user support, user engagement device, and connecting linkage.

45 Claims, 3 Drawing Sheets

U.S. PATENT DOCUMENTS 5,254,067 A 10/1993 Habing et al.
5,330,404 A 7/1994 Lopeleguy et al.
5,330,405 A 7/1994 Habing et al.
5,342,270 A 8/1994 Jones
5,352,171 A 10/1994 Lin
5,354,248 A 10/1994 Rawls et al.
5,356,358 A * 10/1994 Chen ..... 482/96
5,401,227 A 3/1995 Webber
D357,041 S 4/1995 McBride et al.
5,417,634 A 5/1995 Habing
5,478,298 A 12/1995 Chen
5,486,150 A * 1/1996 Randolph ..... 482/133
5,498,222 A 3/1996 Hur
5,505,679 A 4/1996 McBride et al.
5,520,599 A 5/1996 Chen
5,527,243 A 6/1996 Chen
5,527,250 A 6/1996 Chen
5,533,953 A 7/1996 Lui et al.
D372,509 S 8/1996 Yang
5,547,444 A 8/1996 Huang
5,573,482 A * 11/1996 Wang et al. ..... 482/96
5,580,340 A 12/1996 Yu
5,582,563 A 12/1996 Fan
5,616,105 A 4/1997 Wang e
5,626,542 A 5/1997 Dalebout et al.
D383,814 S * 9/1997 Ward ..... D21/674
5,669,865 A 9/1997 Gordon
5,674,161 A 10/1997 Lin
5,681,247 A 10/1997 Webber
5,683,334 A 11/1997 Webber
5,690,593 A * 11/1997 Huang ..... 482/96
5,695,435 A * 12/1997 Dalebout et al. ..... 482/96
5,720,695 A 2/1998 Eckmann
5,722,918 A * 3/1998 Lee ..... 482/72
5,800,321 A 9/1998 Webber
5,810,698 A 9/1998 Hullett et al.
5,899,836 A 5/1999 Chen
5,916,072 A 6/1999 Webber
5,938,570 A 8/1999 Maresh
5,961,427 A 10/1999 Habing et al.
5,961,428 A 10/1999 Webber
6,004,247 A 12/1999 Webber
6,030,322 A 2/2000 Webber
6,090,020 A 7/2000 Webber
6,135,930 A 10/2000 Kuo
6,142,914 A 11/2000 Crawford et al.
6,162,153 A 12/2000 Perez et al.
6,264,588 B1 7/2001 Ellis
6,312,366 B1 11/2001 Prusick
6,319,178 B1 11/2001 Webber
6,579,213 B1 6/2003 Webber et al.
6,605,024 B2 8/2003 Stearns
6,752,748 B1 6/2004 Scotti
6,811,522 B1 11/2004 McQuinn
6,855,098 B2 2/2005 Reitz et al.
6,916,278 B2 7/2005 Webber
6,971,978 B2 12/2005 Hyder
6,988,977 B2 1/2006 Webber et al.
7,052,444 B2 5/2006 Webber
7,052,446 B2 5/2006 Morris et al.
7,070,545 B2 7/2006 Lull et al.
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,361,125 B2 4/2008 Webber et al.
7,384,381 B2 6/2008 Webber et al.
7,468,024 B2 12/2008 Webber et al.
7,553,263 B2 6/2009 Webb et al.
2002/0013199 A1 1/2002 Giannelli et al.
2002/0183173 A1 12/2002 Abelbeck
2002/0187879 A1 12/2002 Ball et al.
2003/0199362 A1 10/2003 Chamberlin
2005/0032611 A1 2/2005 Webber et al.
2006/0247107 A1 11/2006 Carter
2006/0276313 A1 12/2006 Hong
2007/0232462 A1 10/2007 Webber et al.
2007/0232467 A1 10/2007 Puzey
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214365 A1 9/2008 Webber
2008/0214367 A1 9/2008 Webber et al.
2008/0220950 A1 9/2008 Webber et al.
2008/0234110 A1 9/2008 Webber et al.
2008/0242517 A1 10/2008 Webber et al.
2008/0248929 A1 10/2008 Webber et al.

OTHER PUBLICATIONS

Office Action dated Aug. 22, 2008 in U.S. Appl. No. 11/846,437.
Hoist Prime 8 Brochure, Hoist Fitness Systems, 2000.

* cited by examiner

CHEST EXERCISE MACHINE WITH SELF-ALIGNING PIVOTING USER SUPPORT

RELATED APPLICATION

The present application is a Divisional of co-pending U.S. patent application Ser. No. 10/633,805 filed on Aug. 4, 2003, which is also incorporated herein by reference in its entirety.

BACKGROUND

1. Field of the Invention

This invention relates generally to exercise machines, and is particularly concerned with a chest exercise machine.

2. Related Art

Chest exercises include exercises in which the hands travel in a straight line or an elliptical path. In a free weight bench chest press exercise, the exerciser starts with their hands slightly in front of their chest, and then pushes their hands straight outward away from their body. The user may start with their body inclined, flat, or declined, in order to perform incline, flat, or decline chest exercise movements. In a free weight pectoral ("pec") fly exercise, the exerciser lies on a bench with their arms extended out to the side with the elbows bent, holding weights, then lifts the weights to bring them together over their body, with a slight arcing or elliptical pattern to the movement. This exercise may also be performed in an inclined, flat, or declined position in order to involve different muscles.

Chest press and pec fly exercise machines attempt to reproduce the exercise movement of the corresponding free weight exercise using a barbell or dumbbell. One problem is the unnatural and exaggerated arcing movement often found in such machines, which often do not accurately simulate the natural body movement found in a free weight exercise.

SUMMARY

A chest exercise machine in one embodiment comprises a floor engaging main frame, a user support frame pivotally mounted relative to the main frame, a user engagement device movably mounted relative to the frames for actuating by a user in order to perform a chest exercise, and a connecting linkage which translates movement of the user engagement device to movement of the user support frame. A load provides resistance to movement of the user support frame, user engagement device and/or connecting linkage. The connecting linkage, user support pivot mount, and user engagement device mount are arranged so that movement of the user engagement device results in self-aligning movement of the user support.

The user engagement device is movably mounted on the main frame, the user support frame, or the connecting linkage, and in one embodiment the user engagement device comprises one or two articulated exercise arms providing multiple pivoting movements and having handles for gripping by the user. The multiple pivots allow the user engaging handles to self-align to the movement of the user for a user-defined exercise motion.

The user support frame comprises primary and secondary supports which support spaced positions on a user's body throughout an exercise. In one embodiment, the primary support is a seat pad and the secondary support is a back pad. The user support frame may also have a supplementary stabilization means such as a foot rest, which may be mounted on, and travel with, the user support frame. Alternatively, a foot rest may be mounted on the main frame. In either case, the foot rest provides additional stabilization to the user, helping them to maintain a proper exercise position and providing additional comfort and support. The use of multiple support pads on the user support frame helps to position the exerciser properly and safely. These supports are in fixed alignment to each other and travel together, keeping the user in the same braced position throughout the entire exercise range of motion. This allows the user to focus on the exercise rather than worrying about their positioning on a moving platform or seat.

The connecting linkage translates movement of the user engagement device to movement of the user support frame, and is movably engaged with at least two of the main frame, user engagement device, and user support frame. In one embodiment, the user engagement device is movably mounted on the main frame and associated with the connecting linkage. In another embodiment, the user engagement device is movably mounted on the user support frame. The user support frame and user engagement device may both be movably mounted on the main frame, with the connecting linkage connected between them.

In one embodiment, the user support frame is pivotally mounted for rotation about a pivot axis which defines a vertical gravitational center line of the pivotal movement, and a portion of the combined weight of the user and user support is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the pivoting mechanism's gravitational center line, resulting in either a high initial lifting resistance, or else a resistance "drop off" at the end of the exercise.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage.

The user support frame is mounted to move through a horizontal orientation between the start and end position for an exercise, either rocking rearward from an initial forward incline or rocking forward from an initial rearward incline. The seat pad is forwardly inclined in an exercise start position in one embodiment, and is moved through a horizontal orientation to a rearwardly inclined position in the exercise end position. This action takes the user through three positions throughout the exercise, encompassing the entire range of the chest or pectoral muscles, and simulates incline, flat and decline chest exercise movements between the start and end position of the exercise, for greater muscle involvement. Because the user support frame moves in conjunction with the exercise arm or user engagement device, the arcuate path of the exercise arm relative to the user support is reduced. The result is a more natural feeling exercise movement that more closely replicates the movement found in the corresponding free weight exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a chest exercise machine having a user engagement device and user support which travel in a dependent relationship. The exercise machine in the embodiments disclosed herein is designed to provide a pivoting user support which automatically aligns with movement of the user engagement device or exercise arm and which provides appropriate positioning of the user throughout the entire exercise movement.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
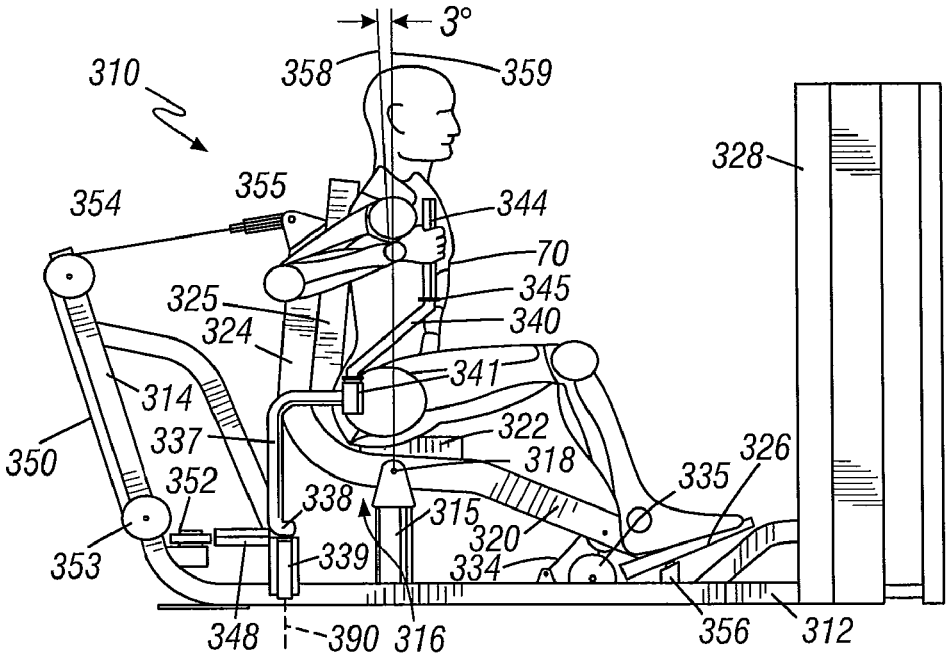
FIG. 1 is a side elevation view of a chest exercise machine according to one embodiment for performing pectoral ("pec") fly exercises, with a user seated on the machine in a start position adopted at the beginning of an exercise movement.
Figure 2:
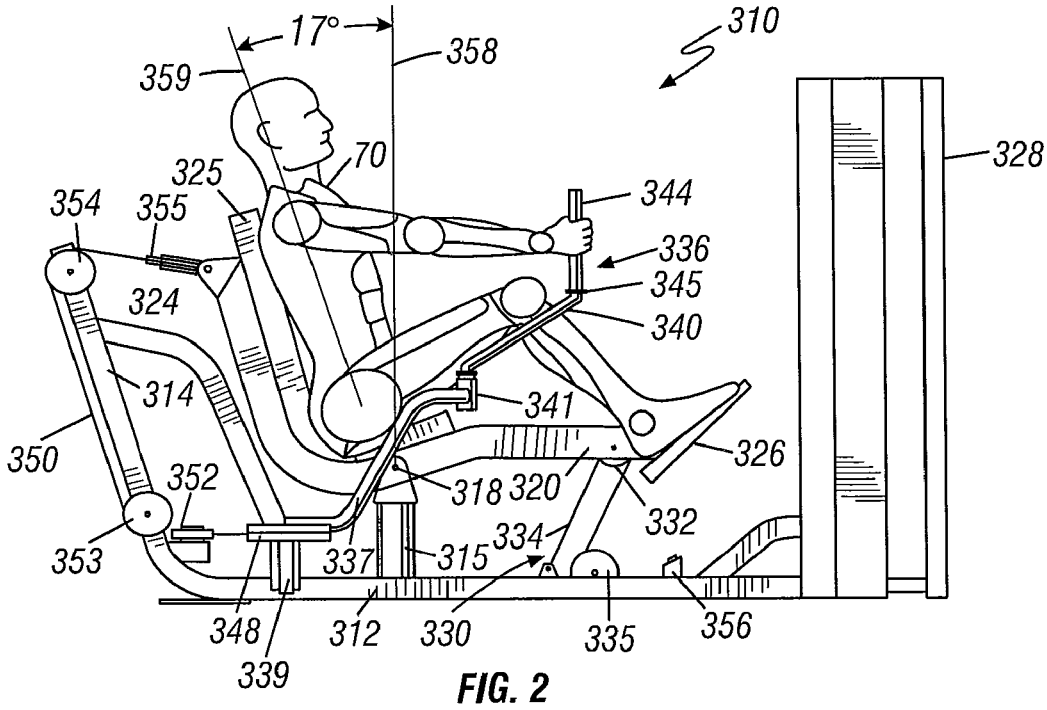
FIG. 2 is a side elevation view of the machine of FIG. 1, illustrating the user and machine in an exercise ending position.
Figure 3:
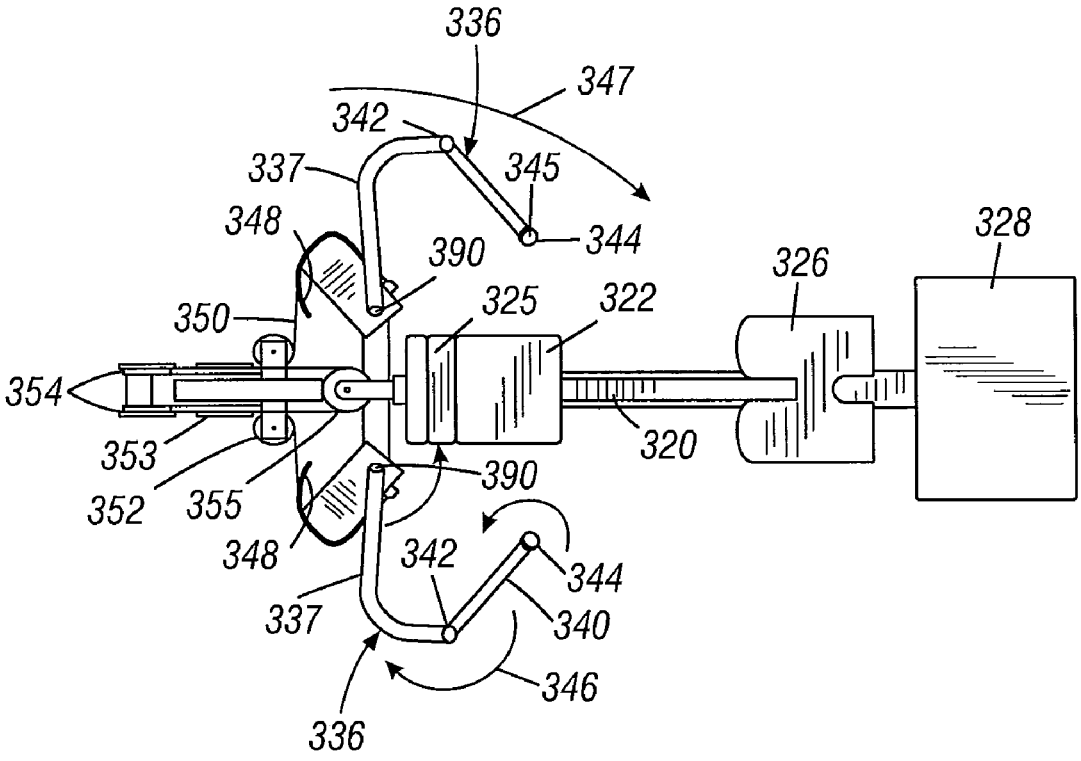
FIG. 3 is a top plan view of the exercise machine of FIG. 1 in the start position.
Figure 4:
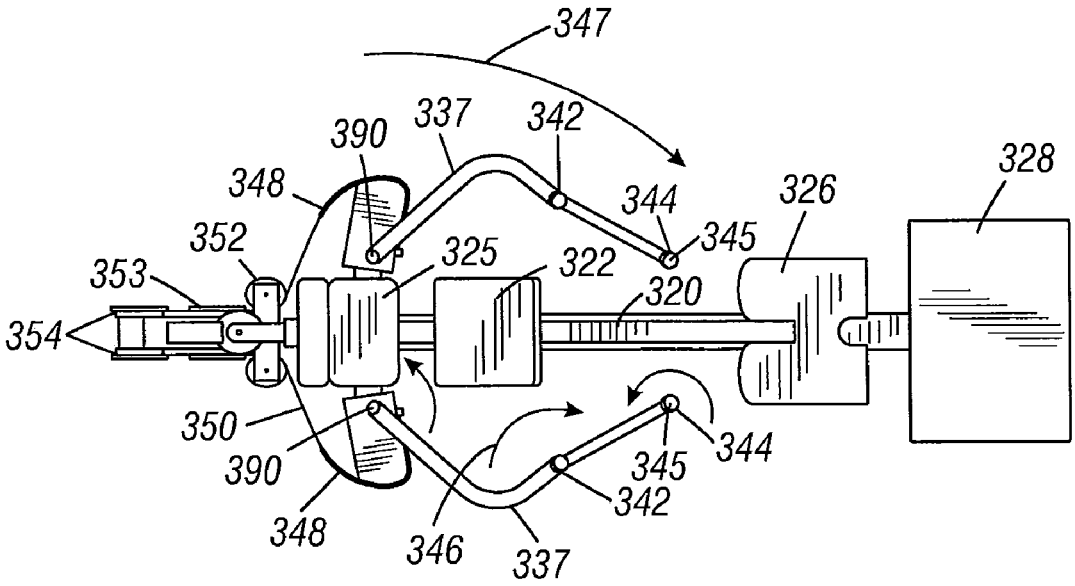
FIG. 4 is a top plan view similar to FIG. 3, illustrating the exercise end position.

FIGS. 1 to 4 illustrate a chest exercise machine 310 according to one embodiment of the invention for performing pectoral fly ("pec fly") exercises similar to a free weight pectoral fly exercise, but without the disadvantages of a free weight exercise. In a free weight pec fly exercise, exercises are performed with the exerciser in a flat position on a flat back rest, a decline position on a downwardly reclined back rest, and in an incline position on an upwardly inclined back rest, in order to carry out flat, decline and incline pectoral fly exercises, involving different muscles. The pectoral fly machine of this embodiment is designed to combine all three pectoral fly exercises in one machine, as will be described in more detail below. FIGS. 1 and 3 illustrate the start position of the machine, while FIGS. 2 and 4 illustrate the end position, with FIGS. 1 and 2 illustrating a user 70 performing a pectoral fly exercise on the machine.

The pec fly machine 310 has a main frame comprising a base section 312, a rear upright 314, and a pivot mounting post 315 on the base section. A generally L shaped user support 316 is pivotally mounted on the pivot mounting post 315 via pivot 318. The user support 316 has a base 320 on which a seat pad 322 is mounted, and an upright 324 on which back pad 325 is mounted. A foot rest or foot plate 326 is mounted at the forward end of the base 320. An exercise resistance comprising a selectorized weight stack in housing 328 is linked to the base of the user support via a cable and pulley linkage 330, including a pulley 332 at the forward end of the base 320 adjacent the foot plate, and a cable 334 extending from an anchor on the base of the main frame, around pulley 332, around a second pulley 335 on the frame base, and then into the weight stack housing to extend around additional guide pulleys before linking to the weight stack in a conventional manner.

A pair of multi-part, articulating exercise arms 336 are rotatably mounted via pivot shafts 338 at their first ends in a pivot mount 339 on the base section 312 of the main frame for rotation about first pivot axes 390 defined by shaft 338, one on each side of the user support, as best illustrated in FIGS. 3 and 4. Each exercise arm 336 has a first elongate part or arm portion 337 having a first end pivoted via pivot shaft 338 and a second end, and an elongated handle or second arm portion 340 which has a first end rotatably mounted via a pivot mount (341) on the second end of part 337 for rotation about a second pivot axis 342. A user-engaging grip 344 is rotatably mounted on handle 340 for rotation about a third pivot axis 345. The multiple pivotal connections in each exercise arm allow the handle or second arm portions 340 to rotate inwardly and outwardly about pivot axes 342, as indicated by arrows 346 in FIGS. 3 and 4, while the first arm portions 336 rotate about pivot axes 390, so that the combined movement of the exercise arm portions about pivot axes 390 and 342 results in forward and rearward elliptical travel paths (see arrow 347). In an alternative embodiment, different user engaging handles may be used in place of handles 340, such as flexible handles.

A resistance cam 348 is mounted on each pivot shaft 338. A cable or flexible link 350 has a first end attached to a cam 348 of a first exercise arm, and extends over a first series of pulleys 352,353,354 mounted on the rear upright of the main frame, a swivel pulley 355 pivotally mounted at the upper end of the user support frame, and then around a second series of pulleys 354,353,352 on the opposite side of the rear upright, before attaching to the cam 348 of the second exercise arm. This is the connecting link between the user support and exercise arm, and ensures that forward rotational movement of one or both exercise arms results in rearward rotational movement of the user support.

FIG. 1 illustrates a user 70 seated on the user support with the exercise machine in the start position. The user sits on the seat in a slightly forwardly inclined position, and places their feet on foot pad 326, which rests on a support post 356 on the base of the frame in the start position. They grab the hand grips 344 and push the hand grips and associated exercise arms forward into the end position of FIGS. 2 and 4. In the start position, the user's upper body is inclined forwardly at an orientation of around 3 degrees to the gravitational centerline 358, with line 359 of FIG. 1 indicating the side centerline of the user's upper body. Gravitational centerline 358 of FIG. 1 is the perpendicular or vertical centerline through the user support pivot 318. The user's elbows are bent with the arms out to the side and the hands slightly below the shoulders in the start position, mimicking the start position of the arms for a free weight pec fly, while the body is forwardly inclined, in position for an incline pectoral fly. Pushing the exercise arms forward causes the cams 348 mounted on the exercise arm pivot shafts to rotate, which pulls the cable 350 reeved around the swivel pulley 355 mounted at the upper end of the user support. This causes the user support 316 to pivot rearward about pivot 318 against the exercise resistance linked to the forward end of the user support. This action moves the user from a forwardly inclined position to a slightly reclined position, ending with their arms extending forward in front of their body, as seen in FIG. 2. This is similar to the ending position of the arms for a free weight pec fly exercise, while the body is in a decline pec fly position.

FIGS. 3 and 4 illustrate the movement of the three parts of each articulating or multi-pivoting exercise arm, comprising the first exercise arm portions 337, elongated handle or second arm portions 340, and user-engaging grips or handles 344, from the start to the end position of the exercise. The three pivot axes 390, 342 and 345 replicate the joint movement of the shoulder, elbow, and wrist, respectively, when performing a free weight pectoral dumbbell fly exercise.

The user support pivot 318 is positioned directly under the user in this exercise machine. The gravitational centerline 358 extending through the user support pivot 318 runs very close to the centerline of the user's hip, allowing a balanced portion of the user support and user to be positioned on each side of the line 358 in both the start and end position. Because the user support seat rises upward as it rotates while the exercise arms remain in the same horizontal plane, the positioning of the user's hands, relative to their shoulders, will be slightly higher in the start position than the end position. This, coupled with the fact that the user is in all three pectoral fly positions (decline, flat/straight, and incline) during the exercise, allows this exercise machine to combine all three possible pectoral fly exercises in one exercise movement for greater muscle involvement. In the start position, the user is in an incline pectoral fly position, and travels through a flat or straight pec fly position during the exercise, finishing the exercise in a decline pectoral fly position. This produces an enhanced workout which saves time and money, because three machines or exercise stations providing three pec fly exercises are combined into one.

Figure 5:
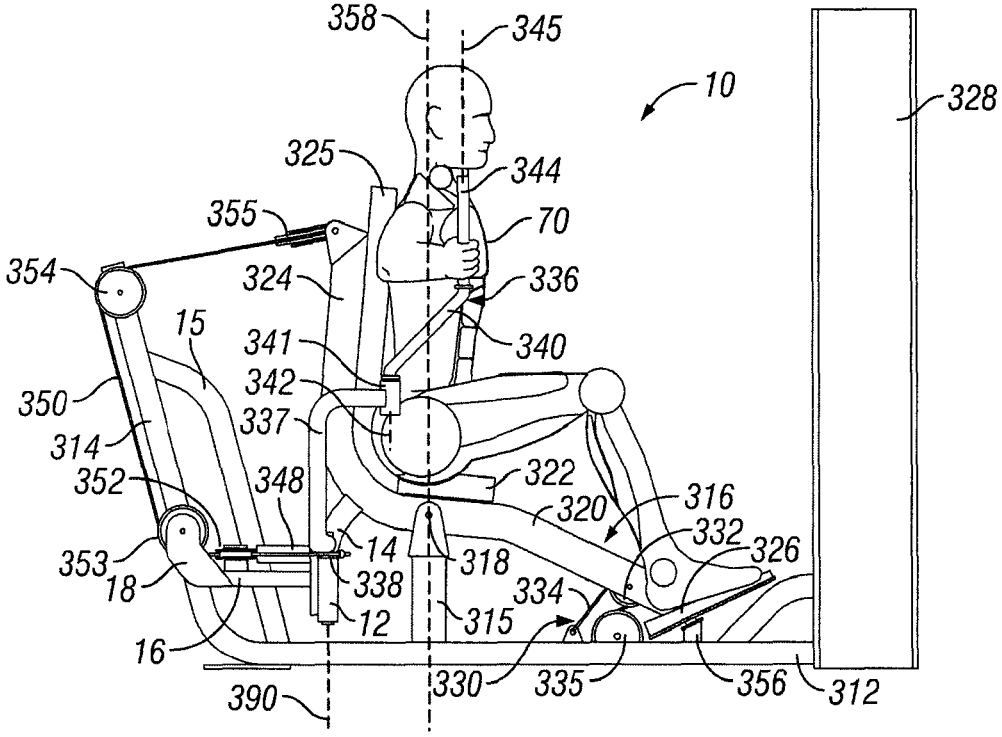
FIG. 5 is a side elevation view of another embodiment of a chest exercise machine in a start position adopted at the beginning of an exercise movement.
Figure 6:
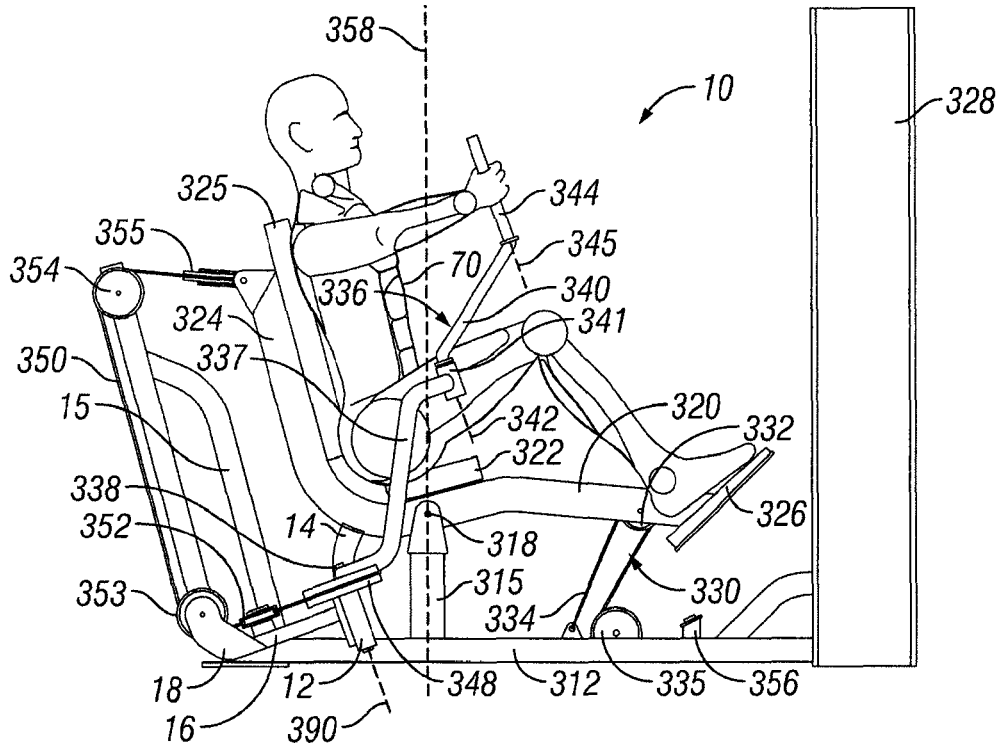
FIG. 6 is a side elevation view of the machine of FIG. 5, illustrating the user and machine in an exercise end position.

In the embodiment of FIGS. 1 to 4, the exercise arms 336 are pivotally mounted on the stationary frame, so that the user support travels away from the exercise arm pivot axes as it rocks rearward. FIGS. 5 and 6 illustrate a modified pec fly exercise machine 10 in which exercise arms 336 are instead pivotally mounted on the pivoting user support 316, as described in more detail below. Other parts of the machine 10 are identical to the previous embodiment, and like reference numbers are used for like parts as appropriate. Because the exercise arms travel with the user support in this embodiment, they stay in the same orientation to the user throughout the exercise motion, resulting in a slightly different user arm movement, as explained below.

As in the previous embodiment, exercise machine 10 has a main frame comprising a base section 312, a rear upright 314, and a pivot mounting post 315 on the base section. A generally L shaped user support 316 is pivotally mounted on the pivot mounting post 315 via pivot 318. The user support 316 has a base 320 on which a seat pad 322 is mounted, and an upright 324 on which back pad 325 is mounted. A foot rest or foot plate 326 is mounted at the forward end of the base 320. An exercise resistance comprising a selectorized weight stack in housing 328 is linked to the base of the user support via a cable and pulley linkage 330, including a pulley 332 at the forward end of the base 320 adjacent the foot plate, and a cable 334 extending from an anchor on the base of the main frame, around pulley 332, around a second pulley 335 on the frame base, and then into the weight stack housing to extend around additional guide pulleys before linking to the weight stack in a conventional manner.

In this embodiment, unlike the previous embodiment, the multi-part, articulating exercise arm 336 are rotatably mounted via pivot shafts 338 at their first ends in respective pivot tubes 12 which are secured to opposite ends of a cross bar (not visible in the drawings) which is suspended from the underside of user support frame at the rear of the frame via support strut 14 which connects to a central region of the cross bar, forming a T-shaped junction. The frame strut 15 is modified slightly to change the bend angle so that it runs parallel to upright 314, unlike the corresponding frame strut of the previous embodiment, so as to provide clearance for the strut 14 meeting the cross bar.

As in the previous embodiment, each exercise arm 336 has a first elongate part or arm portion 337 having a first end pivoted via pivot shaft 338 for rotation about first pivot axis 390, and a second end, and an elongated handle or second arm portion 340 which has a first end rotatably mounted on the second end of part 337 for rotation about pivot axis 342. A user-engaging grip 344 is rotatably mounted on the second end of handle 340 for rotation about pivot axis 345. The pivotal connections between each handle 340 and the respective first arm portion and between each first arm portion and the pivot mount on the user support allow the handles to rotate inwardly and outwardly so that the combined movement of the exercise arm portions about pivot axes 390 and 342 results in forward and rearward elliptical travel paths. As in the first embodiment, different user engaging handles may be used in place of handles 340, 344, such as flexible handles.

In this embodiment, the mounts for some parts of the cable and pulley linkage between each exercise arm and the user support are modified to allow for the different exercise arm mounting arrangement. As in the previous embodiment, a resistance cam 348 is mounted on each pivot shaft 338. However, the pulleys 352 and 353 that feed cable towards the cams in this embodiment are associated with the user support rather than the main frame, so that they travel with the user support as it rocks. A pulley support assembly for pulleys 352 and 353 is provided by a respective rearward extension on each side of the user support. Each support assembly comprises a support tube 16 extending rearwardly from the cross tube which extends between the pivot shaft support struts 12, and a bracket 18 mounted in the vicinity of the end of support tube 16. Pulley 352 is mounted on top of support tube 16, while pulley 353 is rotatably mounted on bracket 18 facing the respective side of the rear upright strut 314 of the main frame. A clearance is provided between each pulley 353 and the respective side of upright strut 314. Cable or flexible link 350 has a first end attached to a cam 348 of a first exercise arm, and extends over the first series of pulleys comprising pulleys 352, 353 associated with the user support and pulley 354 mounted on the rear upright of the main frame, then around a swivel pulley 355 pivotally mounted at the upper end of the user support frame, and around the second series of pulleys comprising pulley 354 mounted on the opposite side of the rear upright, and pulleys 353, 352 mounted on bracket 18 and tube 16 on the opposite side of the user support, before attaching to the cam 348 of the second exercise arm. This is the connecting link between the user support and exercise arm, and ensures that forward rotational movement of one or both exercise arms results in rearward rotational movement of the user support.

FIG. 5 illustrates a user 70 seated on the user support with the exercise machine in the start position. The user sits on the seat in a slightly forwardly inclined position, and places their feet on foot pad 326, which rests on a support post 356 on the base of the frame in the start position. The user then grabs the hand grips 344 and pushes the hand grips and associated exercise arm forward into the end position of FIG. 6. In the start position, the user's upper body is inclined forwardly at an orientation of around 3 degrees to the gravitational centerline 358, similar to the start position in FIG. 1 of the previous embodiment. The user's elbows are bent with the arms out to the side and the hands slightly below the shoulders, mimicking the start position of the arms for a free weight pec fly, while the body is forwardly inclined, in position for an incline pectoral fly. Pushing the exercise arms forward causes the cams 348 mounted on the exercise arm pivot shafts to rotate, which pulls the cable 350 reeved around the swivel pulley 355 mounted at the upper end of the user support. This causes the user support 316 to pivot rearward about pivot 318 against the exercise resistance linked to the forward end of the user support. This action moves the user from a forwardly inclined position to a slightly reclined position, ending with their arms extending forward in front of their body, similar to the ending position of the arms for a free weight pec fly exercise, while the body is in a decline pec fly position.

It can be seen by comparison of the end position of FIG. 6 with that of the previous embodiment in FIG. 2 that the user's arms are not extended as far out in front of their body in the end position of FIG. 6. This is because the exercise arm pivots move with the user support in this embodiment, so that they stay in the same orientation relative to the user support throughout the exercise movement. This results in a slightly less elliptical and more circular movement pattern ending with the user's arms less extended and the hands closer in towards the user's chest. Because of the multiple pivots on the exercise arms 336, the user engaging handles self-align to the movement of the user for a user-defined exercise motion.

As in the previous embodiment, the user support pivot 318 is positioned directly under the user in this exercise machine. The gravitational centerline 358 extending through the user support pivot 318 runs very close to the centerline of the user's hip, allowing a balanced portion of the user support and user to be positioned on each side of the line 358 in both the start and end position. Due to the change in inclination of the user seat throughout the exercise, the user is in all three pectoral fly positions (decline, flat/straight, and incline) during the exercise, allowing this exercise machine to combine all three pectoral fly exercises in one exercise movement for greater muscle involvement. In the start position, the user is in an incline pectoral fly position, and travels through a flat or straight pec fly position during the exercise, finishing the exercise in a decline pectoral fly position. As in the previous embodiment, this produces an enhanced workout which saves time and money, because three machines or exercise stations providing three pec fly exercises are combined into one.

Although the exercise machines of the above embodiments are designed for performing pec fly exercises, modified articulating user engagement devices with multiple pivots may also be provided in other embodiments for performing other types of chest exercises. Use of an articulated exercise arm with multiple pivoting movements allows the user engaging handles to self-align to the movement of the user in a user-defined exercise motion. Although the user engagement device in the above embodiments has articulated exercise arms with multiple pivots, the handle and grip may be replaced by a strap handle secured to the end of the pivotally mounted first arm portion of the exercise arm in alternative embodiments.

Either of the above machines may be provided as a stand-alone machine, as an exercise station of a multi-station exercise machine, or as part of a multi-function exercise machine. The multiple user supports provide secure and safe positioning, placing the user in the proper exercise alignment from start to finish, without any adjustment required by the user. The seat and upper body support (chest pad or back pad) travel together in fixed alignment to keep the user in the same position throughout the exercise motion so that the user does not have to worry about balancing on a moving platform or pad. Additional supports or foot plates which also travel with the user support provide a rest for the user's feet during travel of the user support, for added stability.

In each case, the user support is positioned relatively low to the ground in the start and end position, making the machines quicker, easier, and safer to enter and exit. The user does not have to climb up or down in order to get into, or out of, the exercise position. The low profile also makes the machines more economical to produce and less intimidating to the user. The user's position is continuously adjusted throughout the exercise from a slight forward lean, through an upright position, and ending in a rearward lean. In one embodiment, this results in involvement of more chest muscles than would be involved in a corresponding exercise where the exerciser remained in the same position throughout the exercise. The exercise machines in both of the embodiments described above simulate incline, flat and decline chest exercise positions. The first embodiment, where the exercise arms are mounted on the main frame and do not travel with the user support, encompasses the entire range of the pectoral muscles (upper, mid, and lower). The combined exercise arm and user support movement produces an automatic and continuous self-aligning exercise motion that allows enhanced hand and wrist positioning versus free weight and free bar exercises or prior art machines for performing equivalents of such exercises.

In the exercise machines described above, operation of the exercise arms causes a rocking movement of the user support. Due to the position of the user support pivot, the movement of the user and user support has only a small effect on the exercise resistance felt by the user, and there is no high resistance to be overcome in starting the exercise, or large resistance drop-off at the end of the exercise. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the above embodiment may be mixed and interchanged with one another and still incorporate the essence of the above embodiments. Any suitable connecting linkage may be used to link movement of the user engagement means to movement of the user support, and the connecting links could be made adjustable, and may be designed to push or pull, rotate or slide, and still force rotation of the user support. The user support and exercise arm can be designed to travel in the same or opposite directions, and the exercise arm and connecting link may travel in the same or opposite directions. The exercise resistance may be a weight stack linked to part of the apparatus by a cable and pulley arrangement, or may be weight plates mounted on pegs. Any other type of resistance known in the art may alternatively be used, such as hydraulic, pneumatic, electromagnetic, or elastic bands, in place of the weight stack or weight plates. The resistance may be associated with any of the moving parts, i.e. the user support, the exercise arm, or the connecting link.

Different types and forms of components may be used in place of those shown in the drawings. For example, cables could be replaced with belts, ropes, chains or any type of elongate, flexible member, and pulleys may be replaced by sprockets. The back pad and/or foot plate could be mounted to adjust in position or angle. The exercise arm could be one piece (dependent) or two pieces for independent arm movement, uni-directional or bi-directional, and may be mounted on the user support, main frame, or connecting link, and the exercise arm movement may be rotational or linear.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

The invention claimed is:

1. A chest exercise machine, comprising:

a floor-engaging main frame having a forward end and a rear end;

a user support frame pivotally associated with the main frame and movable between a start position and an end position during an exercise;

the user support frame having at least a primary support and a secondary support for supporting spaced positions on a user's body throughout an exercise movement, the secondary support being fixed at a predetermined angular orientation relative to the primary support, the primary support being configured to support the majority of a user's weight in the start position of the user support frame;

a user engagement device comprising at least one exercise arm movably mounted relative to the frames and having at least one handle for gripping by a user positioned on the user support, the the exercise arm being articulated and having at least one substantially vertical pivot axis, the exercise arm being movable in a user-defined chest exercise movement path during an exercise;

a connecting linkage which translates movement of the user engagement device to movement of the user support frame; and a load for resisting movement of at least one of the user support, user engagement device, and connecting linkage;

whereby the combined motion of the user, user support, and user engagement device substantially replicates the natural movement of the upper part of a human body when performing a chest exercise.

2. The machine of claim 1, wherein the user support frame is configured to support a user in a seated position, the primary support comprises a seat pad and the secondary support comprises an upper body engaging pad.

3. The machine of claim 2, wherein the secondary support comprises a back pad.

4. The machine of claim 2, further comprising an additional support which is configured to support a different part of a user's body from the seat and upper body pads.

5. The machine of claim 4, wherein the additional support comprises a foot support for the user's feet.

6. The machine of claim 1, further comprising a single pivot connection pivotally connecting the user support frame to the main frame and located at a lower elevation than a user engaging part of the primary user support.

7. The machine of claim 1, wherein the user engagement device is movably mounted on the main frame.

8. The machine of claim 1, wherein the user engagement device further comprises a second articulated exercise arm having a handle and having at least one substantially vertical pivot axis, the exercise arms being located on opposite sides of the user support frame.

9. The machine of claim 8, wherein each exercise arm has a first part pivotally associated with one of the frames for rotation about a first pivot axis and a second part pivotally associated with the first part for rotation about a second pivot axis.

10. The machine of claim 9, wherein the first part of each exercise arm is pivotally associated with the main frame.

11. The machine of claim 9, wherein each handle is pivotally associated with the second part of the respective exercise arm for rotation about a third pivot axis.

12. The machine of claim 1, further comprising a user support pivot mount on the main frame, the user support pivot mount defining a vertical gravitational center line of the pivotal movement of the user support, and portions of the user support being positioned on opposite sides of the gravitational center line in at least one of the start and end position of the chest exercise.

13. The machine of claim 1, wherein the connecting linkage comprises a flexible linkage.

14. The machine of claim 13, wherein the connecting linkage comprises a cable and pulley assembly extending between the user engagement device and the user support frame.

15. The machine of claim 14, wherein the cable and pulley assembly comprises at least one pulley mounted on the main frame and a cable which extends around the pulley.

16. The machine of claim 15, wherein the cable and pulley assembly includes a series of pulleys mounted on the main frame in a path from the user engagement device to the user support frame, the cable extending around the series of pulleys.

17. The machine of claim 1, wherein the primary support comprises a seat pad and the end position of the seat pad is at a different angular orientation relative to the start position.

18. The machine of claim 17, wherein the seat pad is forwardly inclined in the start position of the user support frame and rotates rearwardly from the forwardly inclined position during an exercise.

19. The machine of claim 17, wherein the seat pad is rearwardly reclined in the end position of the user support frame.

20. The machine of claim 1, wherein the user engagement device and user support frame move in opposite directions during an exercise.

21. The machine of claim 1, wherein the exercise is a chest press exercise.

22. The machine of claim 1, wherein the exercise is a pectoral fly exercise.

23. The machine of claim 2, wherein the user engagement device is configured to locate the handle at a first position relative to the upper body engaging pad proximate a user's chest when the user is seated on the user support with their upper body engaging the upper body engaging pad in the start position of an exercise, and the handle is spaced forwardly from the first position in the end position of an exercise, and the combined motion of the user, user support frame, and user engagement device substantially replicates the natural movement of the upper part of a human body when performing a free weight pectoral fly exercise.

24. The machine of claim 1, wherein the user engaging device is configured to locate the handle at a first position in the start position of an exercise, and the handle is spaced inwardly from the first position in the end position of an exercise, and the combined motion of the user, user support frame, and user engagement device substantially replicates the natural movement of the upper part of a human body when performing a free weight pectoral fly exercise.

25. A chest exercise machine, comprising:

a floor-engaging main frame having a forward end and a rear end;

a user support frame pivotally associated with the main frame and movable between a start position and an end position during an exercise;

the user support frame having at least a primary support and a secondary support configured to support spaced positions on a user's body throughout an exercise movement, the secondary support being fixed at a predetermined angular orientation relative to the primary support, the primary support being configured to support the majority of a user's weight in the start position of the user support frame;

a user engagement device comprising at least one exercise arm movably mounted relative to the frames and having at least a first arm portion pivotally associated with one of the frames for rotation about a first pivot axis, a second arm portion pivotally associated with the first arm portion for rotation about a second pivot axis, at least one of the pivot axes comprising a substantially vertical pivot axis, and a handle associated with the second arm portion for gripping by a user, the exercise arm being movable in a user-defined chest exercise movement path;

a connecting linkage which translates movement of the user engagement device to movement of the user support frame; and a load for resisting movement of at least one of the user support, user engagement device, and connecting linkage;

whereby the combined motion of the user, user support, and user engagement device substantially replicates the natural movement of the upper part of a human body when performing a chest exercise.

26. A chest exercise machine, comprising:

a floor-engaging main frame having a forward end and a rear end;

a user support frame pivotally associated with the main frame and movable between a start position and an end position during an exercise;

the user support frame having at least a primary support and a secondary support configured to support spaced positions on a user's body throughout an exercise movement, the secondary support being fixed at a predetermined angular orientation relative to the primary support, the primary support being configured to support the majority of a user's weight in the start position of the user support frame;

a user engagement device comprising at least one exercise arm movably mounted relative to the frames and having at least a first arm portion pivotally associated with one of the frames for rotation about a first pivot axis, a second arm portion pivotally associated with the first arm portion for rotation about a second pivot axis, and a handle associated with the second arm portion for gripping by a user, the exercise arm being movable in a user-defined chest exercise movement path, wherein the first and second pivot axes are vertical pivot axes;

a connecting linkage which translates movement of the user engagement device to movement of the user support frame; and a load for resisting movement of at least one of the user support, user engagement device, and connecting linkage;

whereby the combined motion of the user, user support, and user engagement device substantially replicates the natural movement of the upper part of a human body when performing a chest exercise.

27. The machine of claim 25, wherein the handle is pivotally associated with the second arm portion for rotation about a third pivot axis.

28. The machine of claim 27, wherein the three pivot axes are parallel, substantially vertical axes.

29. The machine of claim 25, wherein the first arm portion is pivotally associated with the main frame for rotation about the first pivot axis.

30. The machine of claim 25, wherein the user engagement device further comprises a second exercise arm identical to the first exercise arm, and the first and second exercise arms are located on opposite sides of the user support frame.

31. The machine of claim 30, wherein each exercise arm has a first arm portion pivotally associated with the main frame.

32. The machine of claim 25, further comprising a pivot assembly pivotally mounting the user support frame relative to the main frame which allows rotation of the user support frame between a start position and an end position, the pivot assembly having at least one pivot and defining a vertical gravitational center line of the pivotal movement of the user support frame.

33. A chest exercise machine, comprising:

a floor-engaging main frame having a forward end and a rear end;

a user support frame pivotally associated with the main frame and movable between a start position and an end position during an exercise, the user support frame being configured to support a user in an exercise position on the user support frame during an exercise;

the user support frame having at least a primary support and a secondary support configured for supporting spaced positions on a user's body throughout an exercise movement when the user is positioned in the exercise position on the user support frame, the secondary support being fixed at a predetermined angular orientation relative to the primary support, the primary support being configured to support the majority of a user's weight in the start position of the user support frame;

a pivot assembly pivotally mounting the user support frame relative to the main frame which allows rotation of the user support frame between a start position and an end position, the pivot assembly having at least one pivot and defining a vertical gravitational center line of the pivotal movement of the user support frame;

wherein portions of the user and user support frame are located on both sides of the vertical gravitational center line in at least one of the start and end position of a chest exercise;

a user engagement device comprising at least one exercise arm movably mounted relative to the frames and having at least a first arm portion pivotally associated with one of the frames for rotation about a first pivot axis, a second arm portion pivotally associated with the first arm portion for rotation about a second pivot axis, and a handle associated with the second arm portion for gripping by a user, the exercise arm being movable in a user-defined chest exercise movement path;

a connecting linkage which translates movement of the user engagement device to movement of the user support frame; and a load for resisting movement of at least one of the user support, user engagement device, and connecting linkage;

whereby the combined motion of the user, user support, and user engagement device substantially replicates the natural movement of the upper part of a human body when performing a chest exercise.

34. The machine of claim 33, wherein portions of the user and user support frame are located on both sides of the vertical gravitational center line in both the start and end position of an exercise.

35. The machine of claim 25, wherein the chest exercise comprises a pectoral fly exercise.

36. A chest exercise machine, comprising:

a floor-engaging main frame having a forward end and a rear end;

a user support frame pivotally associated with the main frame and movable between a start position and an end position during an exercise, the user support frame being configured to support a user in an exercise position during an exercise;

the user support frame having at least a primary support and a secondary support configured to support spaced positions on a user's body throughout an exercise movement, the secondary support being fixed at a predetermined angular orientation relative to the primary support, the primary support being configured to support the majority of a user's weight in the start position of the user support frame;

a user engagement device comprising at least one exercise arm movably mounted relative to the frames and having at least a first arm portion pivotally associated with one of the frames for rotation about a substantially vertical pivot axis, a second arm portion associated with the first arm portion for movement relative to the first arm portion, and a grip which is gripped by a user to perform an exercise, the exercise arm being movable in a user-defined chest exercise movement path;

a connecting linkage which translates movement of the user engagement device to movement of the user support frame; and a load for resisting movement of at least one of the user support, user engagement device, and connecting linkage;

whereby the combined motion of the user, user support, and user engagement device substantially replicates the natural movement of the upper part of a human body when performing a chest exercise.

37. The machine of claim 36, wherein the user engagement device is configured to locate the grip at a first position relative to the user support in the start position of an exercise, and the grip is spaced forwardly from the first position in the end position of an exercise, whereby the grip is spaced further from the chest of a user seated on the user support in the exercise position in the second position than in the first position, and the combined motion of the user, user support frame, and user engagement device substantially replicates the natural movement of the upper part of a human body when performing a free weight chest exercise.

38. The machine of claim 36, wherein the first and second arm portions are configured to locate the grip at a first position relative to the user support in the start position of an exercise, and at a position spaced inwardly from the first position in the end position of an exercise, and the combined motion of the user, user support frame, and user engagement device substantially replicates the natural movement of the upper part of a human body when performing a free weight chest exercise.

39. The machine of claim 36, further comprising a pivot assembly pivotally mounting the user support frame relative to the main frame which allows rotation of the user support frame between a start position and an end position, the pivot assembly having at least one pivot and defining a vertical gravitational center line of the pivotal movement of the user support frame.

40. The machine of claim 39, wherein portions of the user support frame are located on both sides of the vertical gravitational center line in at least one of the start and end position of the user support frame.

41. The machine of claim 40, wherein portions of the user support frame are located on both sides of the vertical gravitational center line of the vertical gravitational center line in both the start and end position of the user support frame.

42. The machine of claim 1, wherein the user engagement device is movably mounted on the user support frame.

43. The machine of claim 9, wherein the first part of each exercise arm is pivotally associated with the user support frame and the exercise arms travel with the user support frame throughout the exercise movement.

44. The machine of claim 25, wherein the first arm portion is pivotally associated with the user support frame for rotation about the first pivot axis, and the exercise arm travels with the user support frame throughout the exercise.

45. The machine of claim 30, wherein each exercise arm has a first arm portion pivotally associated with the user support frame.

* * * * *